United States Patent [19]

Diehl et al.

[11] Patent Number: 4,802,598

[45] Date of Patent: Feb. 7, 1989

[54] CLOSING FOR A DISCHARGE-PROOF CRYOCONTAINER

[75] Inventors: Werner K. Diehl, Cologne; Heinrich Fieseler, Dormagen; Gerhard SaBmann, Siegen, all of Fed. Rep. of Germany

[73] Assignee: Messer Griesheim GmbH, Fed. Rep. of Germany

[21] Appl. No.: 188,320

[22] Filed: Apr. 29, 1988

[30] Foreign Application Priority Data

May 21, 1987 [DE] Fed. Rep. of Germany ..... 3717053

[51] Int. Cl.[4] ..... B65D 53/06

[52] U.S. Cl. ..... 215/348

[58] Field of Search ..... 215/260, 270, 329, 341, 215/348, 352

[56] References Cited

U.S. PATENT DOCUMENTS 3,442,411 5/1969 McHoney ..... 215/348

4,244,481 1/1981 Kornelis ..... 215/348

*Primary Examiner*—George T. Hall

*Attorney, Agent, or Firm*—Connolly & Huntz

[57] ABSTRACT

A closure for a discharge-proof cryocontainer includes a locking stopper which can be inserted in the container neck while forming a gas escape gap. The gas escape gap is filled at least in part over the entire circumference with a polyamide foam.

3 Claims, 1 Drawing Sheet

CLOSING FOR A DISCHARGE-PROOF CRYOCONTAINER

BACKGROUND OF THE INVENTION

Discharge-proof cryocontainers are vacuum-insulated, double wall containers which have an internal chamber for holding the material samples to be cooled. This chamber is surrounded by the cooling medium, generally liquid nitrogen. The liquid cooling medium is stored in a porous mass which is, therefore, saturated, for example, with liquid nitrogen. The liquid nitrogen can, therefore, not run out when the container tips over or is upside down. The double wall container is closed with a stopper which forms a gas escape gap with the neck of the container.

The cooling medium evaporated as a result of incoming heat escapes through this gas escape gap, for example, gaseous cold nitrogen. The material sample to be cooled can be shipped in these containers.

When these containers are upside down, for example, as a result of a mishap, they do not properly cool any longer. This applies, in particular, for large containers. Large containers in which, for example, animal carcasses such as goats must be kept and shipped at very low temperature are, to be sure, also discharge-proof but cool very poorly when upside down. The reason is that in such containers, determined by the construction, the gas escape gap has a much larger flow cross section than in a small container. When such a large container is upside down, surrounding air enters through the large gas escape gap into the container and causes the liquid nitrogen to evaporate which, in the form of gaseous cold nitrogen, flows downward through the gas escape gap. The relationships can be directly described by free convection since the specific gravity of the cold nitrogen is about four times higher than air.

Penetration of the warm surrounding air into the inside of the container causes a rapid evaporation of the liquid nitrogen so that the container can maintain its cooling function for a short time only. For large containers, hazardous oxygen enrichment inside the container may then, moreover, occur. In addition to the air, water arrives inside the container which contaminates the stored material.

An improvement can be attained by constructing the locking stopper as a locking cover which grasps the outside of the container neck. When the container is upside down, the locking cover then assumes the function of a siphon trap. Penetration of the surrounding air into the container is then no longer possible. But when the container lies on its side, such a siphon does not prevent the penetration of air into the container.

SUMMARY OF INVENTION

The invention is based on the objective of providing a closing for a discharge-proof cryocontainers of any size which prevents the penetration of surrounding air into the container in any cryocontainer position.

In accordance with the invention a locking stopper is inserted in the container neck forming a gas escape gap. The gap is filled at least in part with a polyamide foam, preferably glued on the locking stopper.

The polyamide foam employed according to the invention to fill the gas escape gap is an insulation medium used in the aircraft industry, which is extremely fire-proof. It is porous and elastic and retains its elasticity even at liquid nitrogen temperatures.

The production for these polyamide foams is described in U.S. Pat. No. Re. 30213 and U.S. Pat. No. 4,369,261.

The polyamide foam can be glued around the stopper since it is abrasion-proof.

THE DRAWINGS

DETAILED DESCRIPTION

Figure 1:
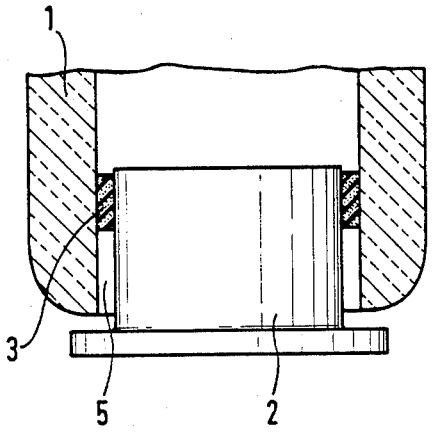
FIG. 1 shows in section a locking stopper with a polyamide foam glued in place.
Figure 2:
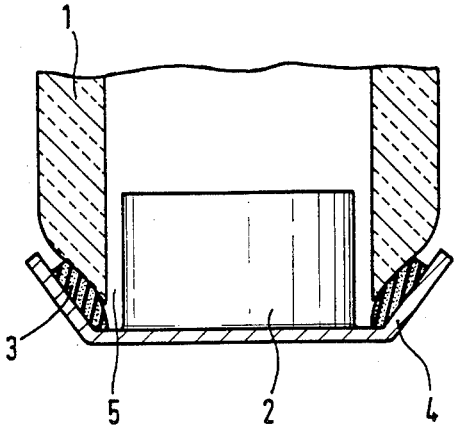
FIG. 2 shows in section a locking stopper with cover whereby the polyamide foam has been glued on the cover.

FIGS. 1 and 2 only show the container neck 1 with inserted locking stopper 2 of upside down containers. In the embodiment of FIG. 1, the polyamide foam 3 is glued on the locking stopper 2. In the embodiment of FIG. 2, the locking stopper 2 has a cover 4 which grasps the container neck 1. The polyamide foam 3 in this case is glued on the inside of the cover 3 so that it adapts to the contours of the container neck 1 when the locking stopper 2 is inserted under light pressure. Lugs which prevent the locking stopper from falling out are not shown in either case.

In addition to the embodiments shown in FIGS. 1 and 2, other variations are also possible. It is only important that the entire free flow cross section of the gas escape gap 5 is everywhere completely filled with polyamide foam. For safety reasons, each container should also be provided with a safety valve which protects the inside container against impermissible overpressure.

Figure 3:
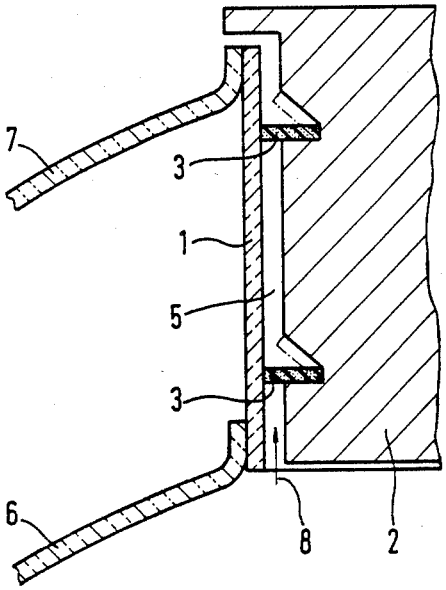
FIG. 3 shows in section a locking stopper which is secured against a vacuum break in the container.

FIG. 3 shows an embodiment which is secured against a vacuum break in the container. The container consisting of inside container 6, outside container 7 and container neck 1 is shown upright. The locking stopper 2 has wedge-shaped annular grooves in which the polyamide foam has been inserted in the shape of rings. With a vacuum break, the nitrogen evaporates rapidly and flows in the direction of the arrow 8 through the gas escape gap 5. Since the polyamide foam 3 even at the temperature of liquid nitrogen remains elastic, it is deformed with increasing inside pressure and assumes the position shown in interrupted lines so that the maximum possible gap cross section is made free. Another function of the foam in the gas escape gap is the prevention of diffusion, for example, as a result of partial pressure differences between the inside space of the container and surrounding atmosphere.

The use in space travel is a specific application of the invention since in circling the earth, the force of gravitation is compensated, the effect of the ascending force is eliminated which on earth as a result of the high density of the cold gas prevents a penetration of surrounding air into the upright container.

SUMMARY

In discharge-proof cryocontainers, even when the container is upside down, surrounding air may not enter the inside of the container through the gas escape gap formed between the neck of the container and locking element, and displace the cooling medium. This is especially difficult for large containers having a thick-walled container neck and a locking stopper 2 inserted in this container neck while forming a gas escape gap 5 since the cross section of the gas escape gap is too large to effectively resist the penetration of air. This problem is eliminated by filling the gas escape gap at least in part over the entire circumference with polyamide foam 3 (FIG. 1).

What is claimed is:

1. In a closing for a discharge-proof cryocontainer with a locking stopper which can be inserted in the container neck while forming a gas escape gap, the improvement being in that said gas escape gap is filled at least in part over the entire circumference with polyamide foam.

2. Closing according to claim 1, characterized in that said polyamide foam is glued on the locking stopper.

3. Closing according to claim 1, characterized in that said gas escape gap is filled over its entire circumference with said polyamide foam.

* * * * *